United States Patent [19]

Strawick

[11] 4,086,723

[45] May 2, 1978

[54] CHEMI-LUMINESCENT FLYING SAUCER TOY

[76] Inventor: Raymond L. Strawick, 52 N. Lynwood, Phoenix, Ariz. 85003

[21] Appl. No.: 727,782

[22] Filed: Sep. 29, 1976

[51] Int. Cl.[2] ..... A63H 27/00; A63B 65/00

[52] U.S. Cl. ..... 46/74 D; 273/106 R; 273/DIG. 24; 362/34

[58] Field of Search ..... 46/74 D; 273/DIG. 24, 273/106 R; 240/2.25

[56] References Cited

U.S. PATENT DOCUMENTS

| | | | |
|---|---|---|---|
| 3,359,678 | 12/1967 | Headrick | 46/74 D |
| 3,539,794 | 11/1970 | Rauhut et al. | 273/DIG. 24 |
| 3,812,614 | 5/1974 | Harrington | 46/74 D |

*Primary Examiner*—Louis G. Mancene
*Assistant Examiner*—Robert F. Cutting

[57] ABSTRACT

A saucer shaped throwing toy adapted to mount a self-contained chemi-luminescent light source thereto. The saucer includes a pair of dual-arm gripping members on the concave side thereof for mounting the light source therein. The central light source is nested on the toy in a central position which does not disturb the balance or aerodynamics of the toy. The light source illuminates the toy, without generating heat, such that playing time during which the toy can be utilized is expanded into the night-time hours.

3 Claims, 5 Drawing Figures

CHEMI-LUMINESCENT FLYING SAUCER TOY

This invention relates to aerodynamic toys for use in throwing games, and more particularly, to a molded plastic saucer toy having means thereon for attachment of a chemiluminescent light source thereto for providing visibility of said plastic saucer in night-time hours.

Since the late 1950's, the basic molded plastic flying saucer or disc sold under the trademark "Frisbee" has been a popular toy. The saucer or disc is capable of sailing through the air when thrown from one person to another, or when thrown in boomerang fashion. When thrown, the symmetrical disc is rotated abouts its own axis for stability while traveling generally perpendicular to that axis at the same time. One example of the disc is disclosed in U.S. Pat. No. 3,359,678.

The basic molded plastic flying saucer has proven a quite successful toy for outdoor use. However, except where expensive outdoor lighting is provided, such as in some public parks, use of the disc has heretofore been limited to the daylight hours. Applicant's invention extends the useful playtime for the flying saucer into the non-daylight hours.

Recently, portable lightweight chemi-luminescent light sources have been developed for use in emergencies when more common electric light sources are not available. This chemi-luminescent light source includes a pair of reactant compounds, one of which is positioned in a thin glass tube and the other of which is positioned in a pliable plastic tube which completely surrounds the inner glass tube. Such a light source is described in U.S. Pat. No. 3,576,987. In order to mix the chemicals and provide a reaction which produces light, the outer plastic container is bent until the inner glass container breaks providing mixture of the compounds. The light source produced is non-heat generating and provides a strong light source for at least eight hours, with the source dissipating slowly thereafter.

This invention relates to a circular disc made of moldable thermo-plastic which includes a generally flat circular central portion with two opposing sides thereto. The circular portion has an annular rim surrounding it which is integrally formed therewith and extends outwardly of the plane of the circular portion. The circular portion and rim define a generally convex surface forming the outer side of the disc and a generally concave surface forming the inner side of the disc. On the inner side of the disc, fastening means is positioned for fastening a chemi-luminescent light source to the disc, thus making the disc visible during night-time hours. The invention is further directed to the disc defined above in combination with a self-contained device for providing chemi-luminescent light from a chemical reaction of a suitable composition in the presence of a flourescent composition. The device is adapted for fastening to the inner side of the disc. The device includes an outer flexible, cylindrical light transmitter container for a reactive composition, and an inner, rigid, brittle container for another reactive composition.

It is an object of the invention to provide a molded plastic aerodynamic disc toy with means for mounting a self-contained chemi-luminescent light source thereto to extend the time such toy may be utilized into the night-time hours.

It is a further object of the invention to provide an improved saucer disc aerodynamic toy which is illuminated in a self-contained manner.

Other objects, features and advantages of the invention will be apparent from the following detailed disclosure, taken in conjunction with the accompanying sheet of drawings, wherein like reference numerals refer to like parts, in which.

Figure 1:
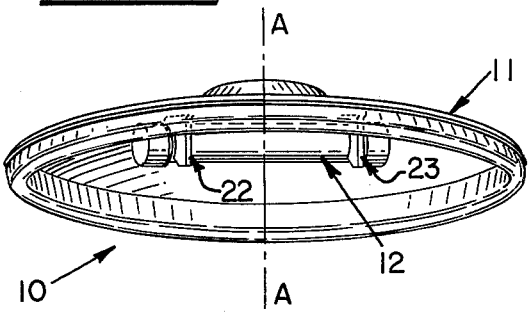
FIG. 1 is a perspective view of the saucer-disc aerodynamic toy of the invention showing the self-contained chemi-luminescent light source attached thereto.
Figure 2:
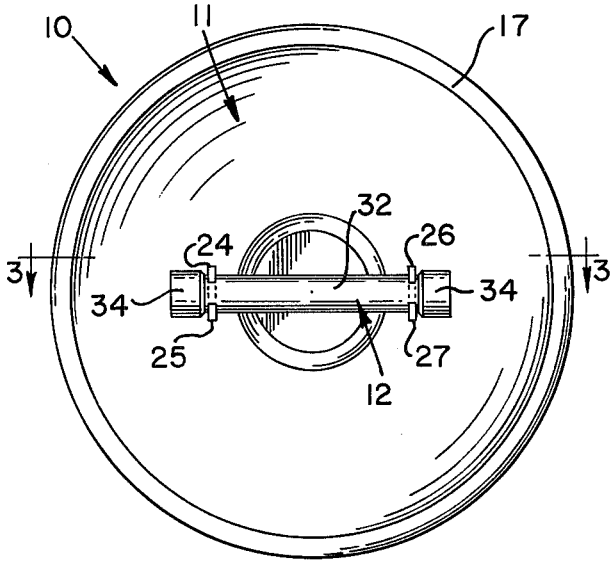
FIG. 2 is a bottom view of the inner side of the disc shown in FIG. 1.

Referring to FIGS. 1 and 2, the chemi-luminescent aerodynamic saucer toy of the invention is indicated by the numeral 10. The chemi-luminescent saucer toy includes generally a molded plastic disc, 11, and a self-contained chemi-luminescent dual-compartment light source, 12, which is attached in nested fashion to the concave underside of the disc 11. The disc may be molded of polyethylene or any other suitable material.

Figure 4:
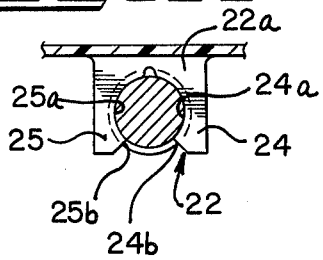
FIG. 4 is a detailed sectional view taken substantially along line 4—4 of FIG. 3.
Figure 3:
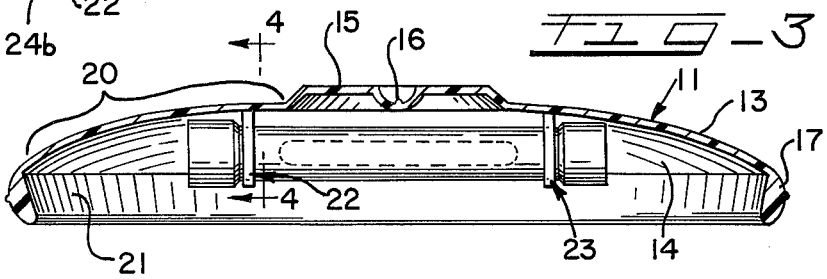
FIG. 3 is a sectional view of the disc of the invention taken substantially along line 3—3 of FIG. 2.

As shown most clearly in FIGS. 3 and 4, disc 11 is symmtrical and includes a generally convex outer or upper surface 13 and a generally concave inner or lower surface 14. A raised portion or cupola 15 is positioned at the center of the symmetrical disc. At the center of the cupola is a depression or nipple 15 at which location the sprue (not shown) is positioned when the disc is molded. Along the outer edge of the disc 11 is positioned a thick annular rim 17 which includes a substantial amount of the mass of the disc. The portion of the disc between the cupola 15 and rim 17 is known as the wing 20. The wing 20 and rim 17 together form an air foil-like shape which provides lift for the disc as it is thrown through the air. The concave inner or bottom surface 14 of the disc generally conforms to the shape of the top surface thus providing a uniform thickness across the wing and cupola. However, the annular inner edge or cheek 21 of the bottom surface is generally flat in crosssection.

In order to mount the chemi-luminescent light source to the disc, pairs of bifurcated clips, generally shown at 22, 23, are positioned at equally spaced and diametrically opposed positions from the axis A—A of disc 11, so as to protrude downwardly from the underside 14 thereof. Each clip 22, 23 includes a solid base portion *22a, 23a*, respectively, and a pair of protruding arms 24, 25, and 26, 27 respectively, which extend downwardly from the base portion. In this embodiment, the bifurcated clips 22, 23 are integrally formed with the disc.

Referring to FIG. 4, one of the two bifurcated clips is shown in detail. Each arm 24, 25 has an inner concave curved surface *24a, 25a*, respectively, which coact to grip the opposing sides of the chemi-luminescent device 12. The outer distal ends *24b, 25b*, respectively, of the respective arms are positioned in closer spatial relation to each other than the spatial relation between the concave portions *24a, 25a* immediately adjacent to the distal ends. This closer spatial relation between the distal ends of each pair of arms allows the chemi-luminescent device 12 to be snapped into position and provides firm gripping for same as mounted therein. It should be noted that the bifurcated clip 23 is substantially idential to the clip 22. The equidistant spacing of the pairs of arms from the central axis of the disc provides a balanced disc as it rotates around the central axis A—A.

To throw the disc, the rim 17, including the cheek 21, is grasped by the thrower's hand. Generally the palm of the hand and the thumb are placed on or adjacent the outer surface of the rim 17 and wing 20, and the fingers of the hand are curled under the disc onto the cheek 21. The disc is thown by drawing the throwing arm across one's body at approximately 90° to the direction of flight. The disc is then rotated about its own axis (line A—A in FIG. 1), thus providing a gyroscopic stabilizing effect to "sail" the disc through the air.

Figure 5:
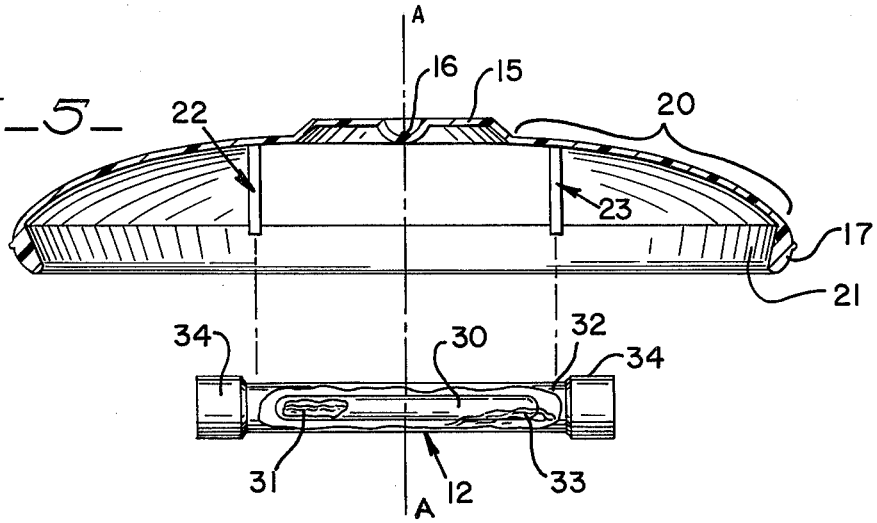
FIG. 5 is an exploded view of the toy showing the saucer-disc in section like shown in FIG. 3 and the light source with parts broken away to illustrate the interior structure thereof.

Referring to FIG. 5, the self-contained chemiluminescent device 12 includes a generally cylindrical hollow glass tube 30 inside of which is position a first reactive substance 31. The ends of tube 30 are sealed in order to isolate the first reactive substance. A generally cylindrical hollow flexible plastic tube, 32, which is substantially larger in diameter than glass tube 30, completely surrounds glass tube 30. A second reactive substance 33 is contained in the hollow portion of plastic tube 32 outside of the glass tube 30. The ends of plastic tube 32 are also sealed thus providing a self-contained device.

The reaction between the two substance which results in luminescence is initiated by bending the middle portion of the plastic tube 32 until the fragile glass tube 30 is broken. The substances then mix. Note, the broken glass remains inside the sealed hollow portion of plastic tube 32. The mixed reactive substances provide a light source which may be seen from approximately one thousand feet away, and which lasts undiminished for approximately eight hours. After eight to ten hours, the intensity of the light source diminishes slowly.

In this embodiment, the light source 12 is completely symmetrical in shape around axis A—A as the device is mounted in the disc 11. This symmetry, plus the automatic balancing characteristics of the liquid reactive substance, provides a combination dynamically balanced disc and luminescent device when the device is mounted on the underside of the disc. In some commercial forms, the chemi-luminescent device does not have like shaped opposing ends. However, the utilization of such non-symmetrical luminescent tubes with the disc is not necessarily precluded.

In this embodiment, the luminescent device 12 includes a pair of enlarged cylindrical ends 34—34. The length of the smaller central portion of the tube 32 approximates the spatial distance between the respective pairs of bifurcated clips 22, 23 in the disc 11, plus the thicknesses of the respective clips. Such a "barbell" shape assures that the tube is mounted on the disc in a balanced position and prevents movement of the tube 32 once mounted on the disc.

In general, the material of which the disc 11 is made is semi-translucent so that the light emitted from device 12 not only appears to the underside of the disc as it is sailed, but also illuminates the entire disc as seen from the top thereof.

The nested position of the luminescent device 12 in the concave underside of the disc 11 has no substantial effect on the aeordynamic qualities of the disc. As the disc sails through the air, the air is directed around the disc and a boundary layer is formed across the bottom of the disc such that the air in the concave portion of the disc is not substantially affected by the flow of air around the disc.

It will be understood that modifications and variations may be effected without departing from the scope of the novel concepts of the present invention, but it is understood that this application is to be limited only by the scope of the appended claims.

The invention is hereby claimed as follows:

1. An illuminated aerodynamic toy comprising in combination:

a circular disc made of a moldable plastic material including a generally flat circular central portion having two opposing sides thereto;

an annular rim surrounding said central portion and integrally formed therewith, said rim extending symmetrically outwardly of the plane of said central portion, said central portion and rim including a convex surface on one side of said central portion and defining an outer side of said disc, and a concave surface on the opposing side of said central portion and defining an inner side of said disc;

a pair of bifurcated members extending from said inner side of said disc and positioned in equally spaced relation to an axis thereof extending perpendicularly to the plane of said central portion; and a self-contained device for providing chemiluminescent light and adapted for fastening to said pair of bifurcated members, said device having an outer flexible, cylindrical, light transmitting container for one reactive composition, and an inner rigid, brittle container for another reactive composition.

2. The combination called for in claim 1 wherein said self-contained device is balanced as said device is rotated around said axis.

3. The combination called for in claim 2 wherein said outer container of said self-contained device includes a pair of radially expanded opposed ends, and the length of said cylindrical container between said expanded opposed ends is greater than the spatial distance between said pair of bifurcated members and coacts therewith to properly position said device at a balanced position on said disc.

* * * * *